United States Patent [19]

Cross, Jr.

[11] Patent Number: 4,701,256

[45] Date of Patent: Oct. 20, 1987

[54] RECIRCULATING PNEUMATIC SEPARATOR

[75] Inventor: Wiley E. Cross, Jr., Glen Allen, Va.

[73] Assignee: The Cardwell Machine Company, Richmond, Va.

[21] Appl. No.: 809,112

[22] Filed: Dec. 13, 1985

[51] Int. Cl.[4] ..... B07B 4/02

[52] U.S. Cl. ..... 209/139.1; 131/312; 209/153; 209/154

[58] Field of Search ..... 209/139.1, 142, 153, 209/154, 379, 388, 390, 487; 131/109.1, 109.2, 110, 312

[56] References Cited

U.S. PATENT DOCUMENTS

| | | | |
|---|---|---|---|
| 2,421,952 | 6/1947 | Lipsius | 209/487 |
| 3,164,548 | 1/1965 | Rowell et al. | 209/153 |
| 3,608,716 | 9/1971 | Rowell | 209/139 R |
| 3,655,043 | 4/1972 | Wochnowski et al. | 209/154 |
| 4,233,159 | 11/1980 | Senda et al. | 209/388 |
| 4,253,940 | 3/1981 | Price | 209/154 |
| 4,287,064 | 9/1981 | Ando et al. | 209/388 |
| 4,465,194 | 8/1984 | Coleman | 209/142 |

FOREIGN PATENT DOCUMENTS

| | | | |
|---|---|---|---|
| 1059722 | 3/1954 | France | 209/388 |

*Primary Examiner*—Andres Kashnikow
*Assistant Examiner*—Michael J. Forman
*Attorney, Agent, or Firm*—Mason, Fenwick & Lawrence

[57] ABSTRACT

A pneumatic separator for separating lighter particles from heavier stem particles and the like, as in tobacco threshing, including a separating chamber having air circulating in a generally upward path therethrough, an inlet rotary impeller mounted on one side of the separating chamber for thrusting particles to be separated into and across the chamber toward a generally upwardly extending opposite wall of the chamber, an inclined perforated plate member below the level of the impeller for directing larger particles discharged toward or falling onto the inclined plate member for collecting and carrying heavier particles from the chamber, and an air jet impeller located immediately above the inclined plate to discharge an air jet therefrom for directing material into a high arc trajectory into the chamber. An air diffusion granting assembly below the inclined perforated plate member receives air discharged from a fan and has a plurality of directional vanes for reducing air flow and velocity in selected portions of the separating chamber. Air discharge openings are located at a vertical position above the level of the impeller to provide air flow therethrough into the chamber in zones located above the height of such openings.

8 Claims, 4 Drawing Figures

RECIRCULATING PNEUMATIC SEPARATOR

BACKGROUND AND OBJECTS OF THE INVENTION

The present invention relates in general to pneumatic separators for separating heavier material from lighter material, such as, for example, the stems from fragments of tobacco leaves, and more particularly to a recirculating pneumatic separator for tobacco stemmery operations for separating tobacco leaf fragments from stems of tobacco leaves.

Functions normally performed in a tobacco stemmery operation where whole leaf tobacco is processed after leaving the auction warehouse floor are ordering and conditioning of the tobacco leaves, threshing or removal of the lamina from the stem, separation of the lamina and stems, drying, and packing. The present invention is concerned with machinery for ordering and conditioning the tobacco leaves, threshing or removal of the lamina from the stems, and separation of the lamina and stems. The drying and packing of the tobacco leaf fragments is then accomplished by other machinery.

Ordering and conditioning is normally accomplished by tumbling the tobacco in a rotating cylinder with a slightly declining axis of rotation while spraying the tobacco with steam and water. The object is moisten the tobacco making it more pliable and to raise its temperature for the same reason.

Threshing is accomplished by a rotating cylinder with pieces of flat steel (teeth) projecting from the cylinder surface. The axis of rotation is horizontal with the tobacco evenly fed across the upper surface of the cylinder. The teeth grab the leaves, cutting some and tending to tear the lamina from the stems. At the same time the tobacco is thrown radially outward by centrifugal force where it contacts a close fitting concave or basket which encloses the lower portion of the rotating cylinder. The concave has openings through which the tobacco may pass. In the early stages of threshing these openings are fairly large. A standard basket may be a sheet of ¼ inch plate rolled to just clear the teeth. This rolled shape is then cut by torch into a series of diamond shapes with a 2½ inch slot between each row of diamonds. The slots run in the direction of rotation and the diamonds overlap. As the tobacco passes through there is additional cutting of stems and removal of lamina.

Threshing is not 100 percent efficient so several threshers are used with a separator or separators in between. Latter threshers have smaller openings in the concaves and the last one may have 1½ inch to 2 inch round holes.

After separation the lamina and stems are separately dried down to 10–11 percent moisture, cooled and packed into containers by large hydraulic presses for storage for a year or more. During storage, some of the natural starches convert to sugars by natural fermentation.

The machine of the present invention is similar to the prior art recirculating pneumatic separator described in Rowell U.S. Pat. No. 3,608,716, which is designed to receive tobacco from the thresher in an even flow into a regulated uprising air column such that the lighter free lamina rises upward with the air stream and the heavier stem or stem with lamina attached, frequently referred to as flags, fall downward against the air flow to be ejected to the next thresher or another separator. In the machinery of the type disclosed in the prior U.S. Pat. No. 3,608,716, a mixture of free lamina, attached lamina and stem, and clean stem is pneumatically conveyed from the thresher or previous separator into the screening separator. Here the air passes through a rotating screen of perforated metal and is returned to the fan. The tobacco mixture falls down the back wall into a four bladed rotating air lock which passes the tobacco out of the air stream.

Immediately it falls into a high speed six bladed rotating inlet rotor. These blades with resilient tips impart a uniform velocity to the tobacco and hurl it into a chamber, shown at 7 in the patent. A reasonably even air flow uprising through the chamber is induced by a fan or fans.

The lighter lamina or strip, as it is commonly called, has lesser inertia and is effected by the air stream immediately and starts on its journey upward. Stems and flag are less effected by the air since they are heavier and continue more or less to the wall opposite the inlet. An adjustable damper called a ski-jump is located at the lower end of this wall, blocking air flow next to the wall to create a dead air space.

Without air flow, the stem and flag fall to the ski-jump and due to its angularity are directed in the opposite direction and slightly downward across the air stream for the second pass. Some free lamina may be jarred loose and be re-entrained in the air stream.

The lighter material enters the strip discharge section and is locked out to an inspection belt. Air exits each end of the screen, passes through dampers and enters the suction of one or the other of two internal fans.

The internal fans blow into the bottom of the separating section, through a louvered screen to even the air flow and then upward through a perforated belt. The belt serves as an additional air flow equalizer and prevents the heavy material from falling into the bottom of the separator.

The reason for a belt is to provide a means of keeping the perforated holes from stopping up due to small material that may pass through the internal screen seals and be held on the underside of the perforated surface. Using a perforated belt insures that the under surface is always changing to become an upper surface allowing any material to be blown free.

Having completed the second pass across the air stream the heavy material slides across the perforated belt into a pneumatic pick-up to be conveyed to the next thresher or the next separator.

In order to keep the system negative in regards to air pressure, air is bled from the discharge of the fans which convey between the machines (transport fans). All leakage is now on an inward direction which helps to contain the dust and dirt. The make up air enters the machine through holes along each side at the belt level helping to keep the belt seals clean plus air is admitted at the upper end of the belt and blows along the belt surface to assist the heavy material out of the machine.

Air is also exhausted from between the belt from a trough located under the upper surface of the belt. The trough creates a dead air space which allows sand or other material to fall from the belt surface.

Too high air velocity in the separating chamber will cause stems and flags to go with the good strip. Too much stem is not desired and large pieces (called objectionable) are just that. Too low a separating velocity

BEST AVAILABLE COPY lowers the stem content of the separated strip but allows too much good threshed material to pass on to the next thresher or separator. This results in further degradation of the strip and is to be avoided.

Separating air flow is grossly regulated by slide or louver dampers at the suction side of the fans and is finely tuned by use of a single bladed by-pass damper.

Separated strip after leaving the air stream passes through the discharge lock and falls to a belt for delivery to an inspection and collecting belt.

While the philosophy in the tobacco threshing and separating community until a few years ago was to thresh increasing quantities of tobacco and produce a more uniform product (:.e. strip) with less fines and, because of the higher loads, less larger particles, the present approach is toward more larger pieces which means once a particle is threshed from the stem, it should be separated at once without being subjected to additional threshing or handling resulting in degradation of size.

While the recirculating pneumatic separator of the above identified patent met the former requirements, the air jet impeller and air diffusion grating features do not produce the results now desired. It is now recognized that use of a high velocity air stream, while separating more of the good material, has the drawback of also carrying along stem, flag and unthreshed leaves leading to an unacceptable high stem content. However, if a high velocity air stream is used to separate, and then the air is slowed to drop stem, a high separating efficiency and low stem content can be achieved. By use of a novel air jet nozzle arrangement, the apparatus of the present invention is now able to direct the material coming off the air jet impeller vane into a high arc trajectory, so that the jet acts to break tangles or dislodge particles, and the high arc trajectory allows more time for the separating air to interact so that, as the heavier material takes a more downward course at the end of its trajectory, it falls into the area of highest velocity. Because the tobacco is moving downward against the upward air flow, the relative air velocity is increased without an increase in air flow further enhancing the separation. Also, it has been recognized that tobacco, as it enters the threshing separating portion of its processing, contains a very high proportion of sand or silica stuck to or embedded in the tobacco. Threshing and separating tend to dislodge this very abrasive medium and it is desirable to remove it. The apparatus of the present invention includes, as part of the air circuit, a large plenum or settling chamber designed to allow this sand to settle out of the air stream prior to entering the fans. This makes it possible to use lighter construction fan wheels of higher efficiency with considerable savings to the user in power cost.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
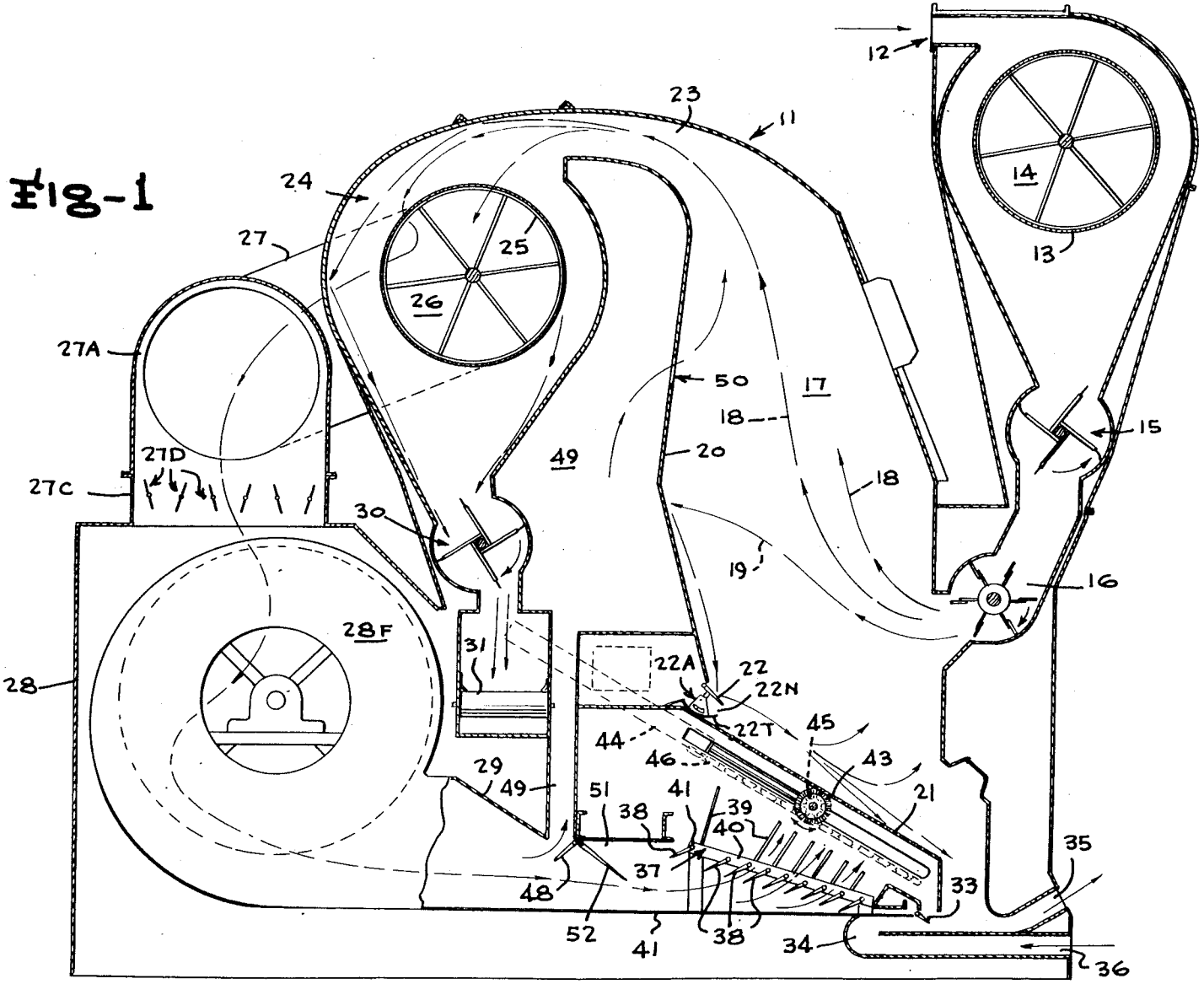
FIG. 1 is a vertical longitudinal section view through the recirculating pneumatic separator.
Figure 2:
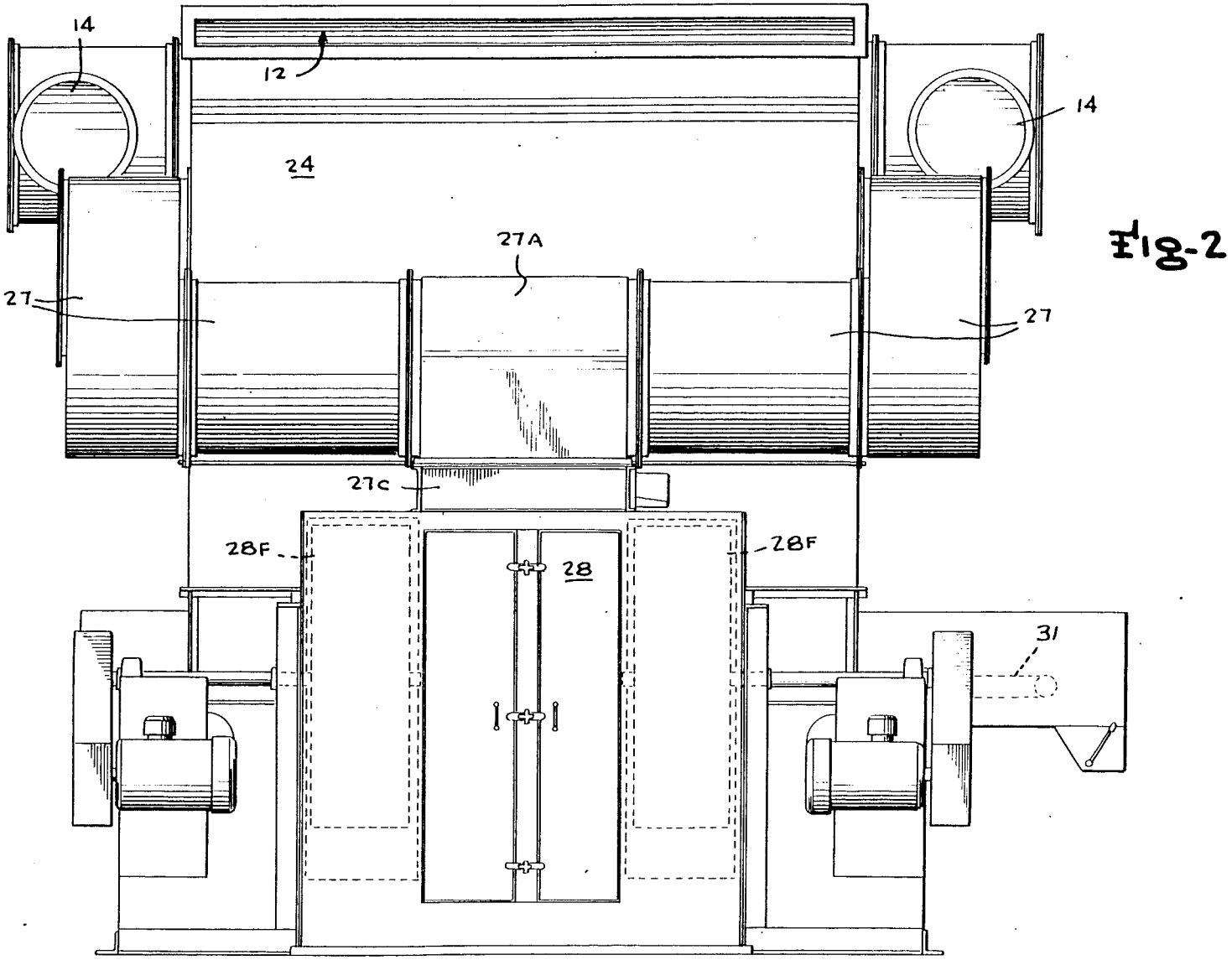
FIG. 2 is a rear end elevational view thereof.
Figure 3:
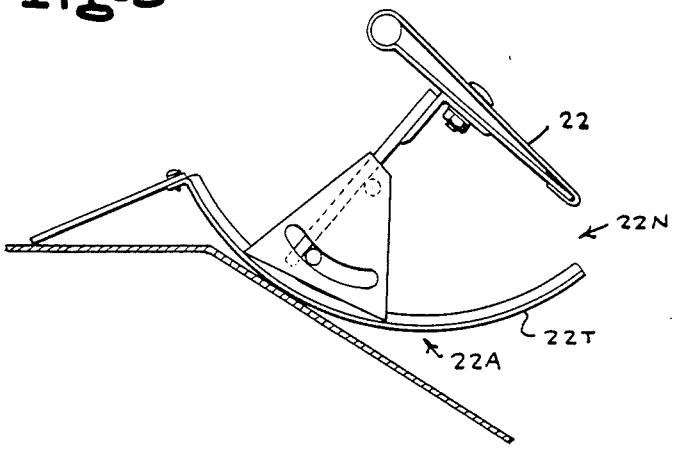
FIG. 3 is a detailed side elevational view of the air jet impeller, viewed from the end of the air jet impeller assembly nearest the viewer.
Figure 4:
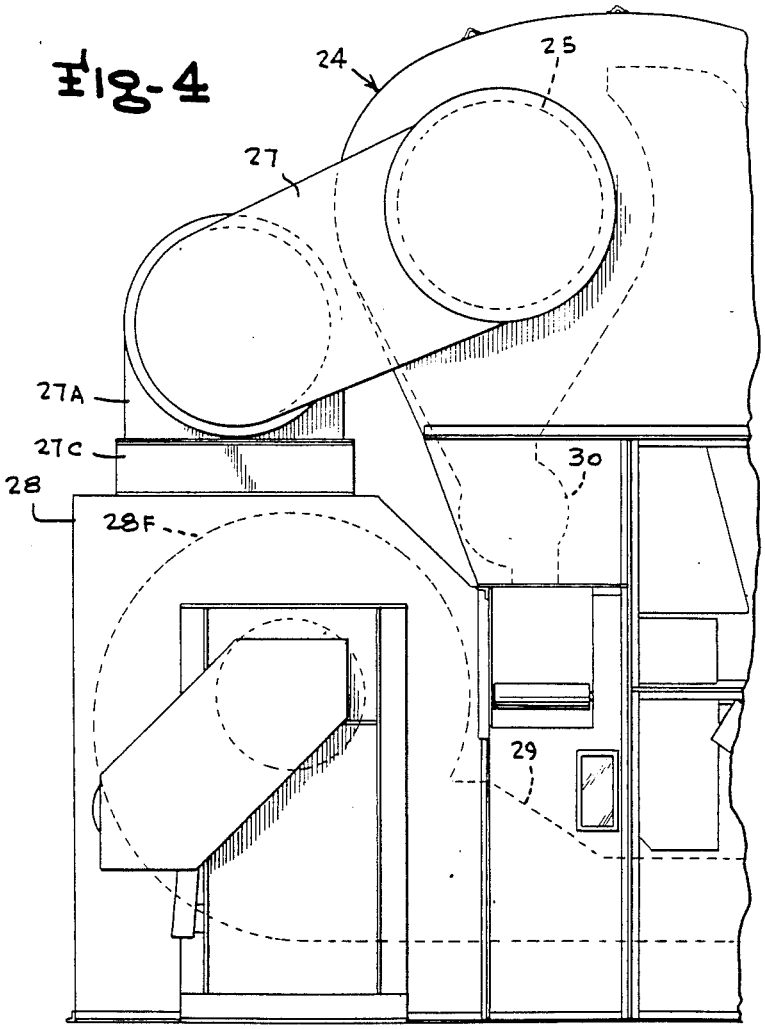
FIG. 4 is a fragmentary side elevational view of the far end of the separator.

Referring to the drawings, wherein like reference characters designate corresponding parts throughout the several figures, the recirculating pneumatic separator of the present invention is housed within the casing structure 11 and the material to be segregated by the pneumatic separator, for example whole leaf tobacco, is fed into the casing structure 11 through an inlet 12, shown in FIG. 1. A rotary screen 13 is provided with a mesh of sufficiently fine size so that it prevents the material being brought into the separator from passing therethrough, although the conveying air which brings the material into the separator passes through the screen and out through an open end 14. Thus the conveying air for the material being fed into the separator forms a closed circuit, passing into the separator through the inlet 12 and out through the passageway 14. There is provided an air lock 15 comprising a plurality of rotary gates which permit the material to be segregated to pass therethrough but prevents any substantial quantity of the conveying air from passing through into the main portion of the pneumatic separator. The material to be treated within the separator passes downwardly where it is engaged by a rotary impeller 16 and is thrust by the vanes of the impeller into the main chamber 17. The impeller imparts to the particles of material to be separated a substantial velocity, for example, within the range of about 1,000 to 1,200 feet per minute. This prevents the heavier particles from immediately dropping to the bottom of the chamber and causes the particles to pass across the chamber and be subjected to the upward passing currents within the main separating chamber 17. The lighter particle fraction is carried upwardly by the upwardly moving air currents as shown at 18, while the heavier particle fraction passes across the chamber as shown at 19, and may abut the wall 20 of the chamber which is opposite the impeller 16. The heavier particles may drop down onto a perforated plate 21 which is inclined downwardly from the vane 22 of the air jet impeller assembly **22*a* or fall out of the air stream in the area near the wall 20 of the main chamber 17. Because of the jet nozzle 22N formed by the air jet impeller assembly, the material coming off of the vane 22** is directed into a high arc trajectory as desired. This new air jet itself acts to break tangles or dislodged particle. In addition, the jet propels the product into the high arc trajectory allowing more time for the separating air to interact with it and finally, as the heavy material takes a more downward course at the end of its trajectory, it falls into the area of highest velocity. Because the tobacco is moving downward against the upward air flow, the relative air velocity is increased without an increase in the air flow further enhancing the separation.

By the present arrangement, the air flow is crowded towards the lower or discharge end of plate 21, producing a higher degree of separation and allowing for makeup air to the heavies circuit with diminished downflow air currents. As this air flows upward, it expands toward the wall opposite the inlet and as it leaves the separating area slows to a velocity yielding good stem content.

The lighter particle fraction passes upwardly through the main separating chamber 17 with the air current passing upwardly through the chamber and through a substantially tangential passageway 23 into a substantially cylindrically chamber 24. Centrally disposed within the chamber 24 is a cylindrical screen 25 which is mounted for rotation within the chamber. The screen 25 is of a mesh size insufficient to permit the passage of the lighter fraction particles which are carried by the air currents, but permit the air to pass therethrough into the central portion 26 and thence outwardly through the open ends of the rotary screen. The air passing through the rotary screen 25 and through the open ends of the screen passes into downwardly inclined ducts 27 which merge inwardly to a housing 27A above and communicating with damper section 27C having motorized dampers 27D. The damper section 27C overlies a large plenum or settling chamber 28 flanked by a pair of rotary fans 28F which draw air through the ducts 27, and force the air through the fan outlet 29 and back into the lower end portion of the separating chamber 17. Thus it can be seen that there is a recirculating system for the air used to effect the separation between the lighter and heavier particle fractions. This recirculating circuit comprises the main chamber 17, the passageway 23, through the rotary screen 24, and outwardly through the open ends of the screen and downwardly through ducts 27, housing 27A, damper section 27C, plenum or settling chamber 28 and fans 28F, and through the fan outlet 29 back through the lower end of the separating chamber 17. The lighter particles fraction passes downwardly within the cylindrical chamber 24 and into an air lock 30. The lighter particle fraction then drops from the air lock 30 onto the take-away belt 31 to be delivered through one side of the casing for collection at a location spaced from the pneumatic separator.

The prior art pneumatic separator of the type disclosed in U.S. Pat. No. 3,608,716 employed an endless foraminous belt, indicated by reference character 11 in that patent, supported by and driven from end rolls. These heavier particles which rest on the foraminous belt were carried along the belt to the heavier particle fraction outlet, indicated by reference character 14 in that earlier patent, and by reference character 35 in the drawings of the present application. The inlet for the heavier particle fraction air conveying system was shown at 17 in that patent and indicated at 36 in the drawings of the present application and the conveying air in the device of the prior patent was conveyed along the passageway, there indicated at 17, into a chamber where a portion of the air was drawn off and the main portion of the air passed through the chamber and back through the passageway 20, corresponding to the passageway 34 of the present application, to the heavier particle fraction outlet 35. Also in the device of the earlier U.S. Pat. No. 3,608,716, a diffuser was provided, indicated by reference character 36 in that patent, providing a series of angularly extending spaced vanes which extend across the separating chamber, so that air passing from the circulating fan outlet passed upwardly through the diffuser and through the lower and upper runs of the endless belt. The diffuser 36 was designed to cause an even flow of air up through the main separating chamber with a uniform velocity across the chamber.

The present invention differs from the foraminous endless belt and diffuser assembly of the earlier apparatus to effect a substantial improvement in the separation of stem and good material. As previously described, a very high air velocity will separate more of the good material with the drawback of also carrying along stem, flag, and unthreshed leaves leading to an unacceptable high stem content. Use of a high velocity air stream to separate and then slow the air to drop stem permits one to obtain a high separating efficiency and a low stem content. Accordingly, in the apparatus of the present invention, an air diffuser assembly, indicated generally by the reference character 37 is provided, receiving a large portion of the air discharged through the outlet 29 of the rotary fan in the fan casing 28, and directing this air upwardly toward the main chamber 17. The air diffusion grating of the earlier U.S. Pat. No. 3,608,716 is replaced with a plurality of adjustable directional vanes 38 and fixed directional vanes 39 arranged to reduce the air flow and velocity in some portions of the separating section while greatly increasing it in other portions. As will be seen, the vanes 38 are adjustably supported on the frame members 40 fixed in the housing and located above the wall 41 defining the lower wall of the outlet duct 29 from the fan in the fan housing 28, the vanes 38 being supported on shafts which extend through openings in the side members of the frame 40 and being adjustable by a threaded bolt system or other known means for fixing the ends of the shaft at various angular positions.

The directional vanes 39 are fixed to the frame 40 and arranged in a pattern to produce the desired variation in the air flow and velocity in the different portions of the separating section. By this arrangement, the air flow can be selectively directed for maximum separating efficiency and low stem content. The fixed perforated plate 21, arranged in an inclined position as illustrated, replaces the diffusion belt of the earlier device of U.S. Pat. No. 3,608,716, and has the advantage of reducing the diffusion of the belt while containing the heavy particles which may fall upon it. Air flow in the area adjacent to the wall opposite to the inlet rotor 16 is restricted, and the flow near the heavies discharge under the inlet is increased.

Since stems on occasion may project into the perforations of the fixed perforated plate 21 and some small material may be held against the bottom of the perforated plate, a cylindrical brush, indicated at 43 is positioned at the underside of the plate and is driven by two air cylinders or pneumatic cylinder and piston units, one of which is indicated at 44, located on opposite sides of the brush, and coupled to the shaft of the brush 43 by bearings permitting rotation of the brush. Sprockets, one of which is indicated in broken lines at 45 are fitted to the brush shaft at the opposite ends thereof, and are, in turn, mounted in bearings in the brush carriers forming the journal bearings for the brush shaft at the ends of the piston arms of the two air cylinders 44. A roller chain, indicated at 46, is lead around the sprockets 45 and fixed to the machine frame at each end of the chain beyond the brush travel path. As the air cylinders 44 move the brush along the underside of the perforated plate 21, the chains 46 cause both ends of the brush 43 to move together without cocking arising from one end advancing ahead of the other. The chains also cause the brush to rotate as it moves, greatly increasing its cleaning ability.

Air from the fan **28*f* in the fan housing 28 and discharged through the fan outlet 29 is divided, some of this air being directed by an adjustable deflecting vane 48 mounted at the downstream inlet edge of a chimney or vertical duct 49** relative to the airstream discharge

BEST AVAILABLE COPY from the fan outlet 29, to pass into a chamber 49 and outwardly through two openings 50 provided in the wall 20 to pass additional separating air into the upper portion of the main separating chamber 17. The remainder of the discharge air from the fan passes into the duct portion 51 to the zone below the adjustable directional vanes 38 and fixed directional vanes 39 to provide the supply air passing upwardly through the spaces between these vanes and through the perforated inclined plate 21. The amount of air passing into this duct portion 51 is further regulated by an adjustable damper 52. The device of the earlier U.S. Pat. No. 3,608,716 employed an adjustable vane 35 at the lower end of the wall in that patent which corresponds to the wall 20 of the apparatus of the present invention, which in the earlier patent was provided to create a dead airspace immediately adjacent to this wall. In the present apparatus, an adjustable vane, indicated at 22, is provided, at a location generally corresponding to that of the fixed vane of the earlier device, so that any material reaching the wall 20 will fall downward and slide off the vane, referred to commonly as "ski jump", which is adjusted to a position and, because it was simply a downwardly declined vane directed at a converging angle toward the upper surface of the foraminous belt, essentially caused air coming under the vane, shown at 35 in the earlier patent, to follow the top of the belt. In the present arrangement, the vane 22 of the air jet impeller assembly 22A also includes an upwardly concave trough or guide surface 22T spaced just below the free end of the vane 22 and positioned and shaped so that the air jet impeller directs the air so as to tend to throw the material in the discharge zone of the jet impeller upward in a trajectory so that it falls into the high velocity air area of the separating chamber 17 so that the heavier materials are subjected to high velocity air. This greatly increases the efficiency of the device in achieving separation of heavies from desired material.

Since the former air jet impeller of the earlier device was a fixed directional air flow arrangement introduced under the vane, although it assisted the material to return across the chamber, it in fact propelled it towards the heavies pickup and provided little opportunity for reseparation. By the present arrangement, the series of adjustable and fixed directional vanes 38 and 39 provide both high velocity and low velocity separating air with the same air flow and produce a considerably more efficient desirable separation of the materials delivered to the main chamber 17. The jet nozzle impeller which is adjustable in direction, flow quantity and velocity, enhances the ability of the normal separating air to separate more efficiently by allowing more time for separation and increasing the relative velocity of the separating without increasing the air flow. Also the fixed perforated inclined plate 21, replacing the perforated belt of the prior device, and the cleaning device for the plate, adds to the separating efficiency by reducing the diffusion of the air supply.

In the present arrangement, since most of the separating air is directed toward the lower end near the heavies discharge, the separating air velocity is low to nil in a triangular section along the portion of the wall 20 immediately above the air jet impeller assembly 22A. Light materials, therefore, which fall out of the higher velocity air stream into this low velocity area are subjected to the high velocity air stream discharged from the jet into the high arc trajectory, separating them readily from the heavies and thus reducing the possibility of their remaining entrapped with the heavies. The adjustable deflecting vane 48 in the discharge of the main separating air fan, located at the inlet to the chimney or upwardly extending duct section 49, forces air up the chimney and through the openings 50 in the wall 20 of the separating chamber 17. Thus the velocity in what is normally a dead area is enchanced preventing light materials from falling while not causing an increase in the separating air velocity until after the separating selection is completed. The shape of the main separating chamber 17 is also altered relative to that of the apparatus of the earlier patent, providing a smaller tighter area producing air movement such that, as the air moves upwardly in the approximately lower half of the separating chamber in the zone immediately in the discharge path from the rotary impeller 16, the chamber becomes larger, the air slows down, and more efficient separation is achieved.

It will also be noted, that as part of the air circuit, the large plenum or settling chamber, indicated at 28, has been provided to allow the sand or silica which was initialiy stuck to or embedded with the tobacco and separates therefrom to settle out of the airstream prior to entering the fans 28F. This feature makes it possible to use lighter construction for the fan wheels providing higher efficiency with considerable savings to the user in power costs, and permits avoidance of the need for heavy low efficiency fans subjected to very high wear.

I claim:

1. A pneumatic separator for separating lighter particles from heavier stem particles and the like, as in tobacco threshing, comprising a separating chamber, means for circulating air in a generally upward path through said chamber, inlet rotary impeller means mounted on one side of said separating chamber having vanes for thrusting particles to be separated into and across the chamber toward a generally upwardly extending opposite wall of said chamber, an inclined perforated plate member defining a bottom wall portion of said chamber below the level of said impeller means for directing larger particles discharged toward or falling onto the inclined plate member for collecting and carrying heavier particles from the chamber, an air jet impeller means located immediately above said inclined plate at a lowermost portion of said opposite wall and means for conducing air to said jet impeller means to discharge an air jet therefrom for directing material into a high arc trajectory into said chamber, an air diffusion grating assembly below said inclined perforated plate member receiving air discharged from a fan and having a plurality of adjustable directional vanes and a plurality of fixed direction vanes, a first group of said vanes being positioned and oriented to reduce air flow and velocity in selected portions of the separating chamber lying above said first group and a second group of said vanes being positioned and oriented to increase air flow and velocity in other portions of the separating chamber lying above said second group to selectively direct upward air flow through said chamber for maximum separating efficiency, and said upwardly opening opposite wall having discharge openings located at a vertical position above said level of said impeller means and means for supplying air through said openings to provide air flow therethrough into said chamber in zones located above the height of said openings.

2. A pneumatic separator as defined in claim 1, wherein said air jet impeller means includes an adjustable inclined pivoted vane separate from said adjustable

BEST AVAILABLE COPY vanes pivoted at one end thereof immediately below said lowermost portion of said opposite wall and a concave curved sheet member spaced a predetermined distance from and confronting a free end of said inclined pivoted vane defining an air jet discharge nozzle with said pivoted vane coactive therewith for adjusting direction, flow quantity and velocity of the air jet discharged therefrom.

3. A pneumatic separator as recited in claim 2, wherein said adjustable and fixed directional vanes in the air diffusion assembly provide both high velocity and low velocity separating air with the same air flow source being discharged from said fan and direct the same upwardly through said separating chamber with the upwardly moving air being distributed nonuniformly across the separating chamber in a predetermined relationship to achieve maximum separating efficiency.

4. A pneumatic separator as defined in claim 3, including cleaning apparatus for cleaning said inclined perforated plate member, the plate member having a width to extend entirely across the chamber and having an uppermost end and a lowermost end, the cleaning apparatus comprising a rotatable brush member having a brush surface bearing upwardly against an underside of the inclined perforated plate and rotatable about an axis of rotation paralleling said inclined perforated plate and transversely spanning the width thereof, and means for moving said brush in a reciprocative rectilinear path paralleling said inclined perforated plate from the uppermost end to the lowermost end thereof.

5. A pneumatic separator as defined in claim 2, including cleaning apparatus for cleaning said inclined perforated plate member, the plate member having a width to extend entirely across the chamber and having an uppermost end and a lowermost end, the cleaning apparatus comprising a rotatable brush member having a brush surface bearing upwardly against an underside of the inclined perforated plate and rotatable about an axis of rotation paralleling said inclined perforated plate and transversely spanning the width thereof, and means for moving said brush in a reciprocative rectilinear path paralleling said inclined perforated plate from the uppermost end to the lowermost end thereof.

6. A pneumatic separator as recited in claim 1, wherein said adjustable and fixed directional vanes in the air diffusion grating assembly provide both high velocity and low velocity separating air with the same air flow source being discharged from said fan and direct the same upwardly through said separating chamber with the upwardly moving air being distributed nonuniformly across the separating chamber in a predetermined relationship to achieve maximum separating efficiency.

7. A pneumatic separator as defined in claim 6, including cleaning apparatus for cleaning said inclined perforated plate member, the plate member having a width to extend entirely across the chamber and having an uppermost end and a lowermost end, the cleaning apparatus comprising a rotatable brush member having a brush surface bearing upwardly against an underside of the inclined perforated plate and rotatable about an axis of rotation paralleling said inclined perforated plate and transversely spanning the width thereof, and means for moving said brush in a reciprocative rectilinear path paralleling said inclined perforated plate from the uppermost end to the lowermost end thereof.

8. A pneumatic separator as defined in claim 1, including cleaning apparatus for cleaning said inclined perforated plate member, the plate member having a width to extend entirely across the chamber and having an uppermost end and a lowermost end, the cleaning apparatus comprising a rotatable brush member having a brush surface bearing upwardly against an underside of the inclined perforated plate and rotatable about an axis of rotation paralleling said inclined perforated plate and transversely spanning the width thereof, and means for moving said brush in a reciprocative rectilinear path paralleling said inclined perforated plate from the uppermost end to the lowermost end thereof.

* * * * *